United States Patent [19]

Reifenhauser

[11] Patent Number: 4,811,418

[45] Date of Patent: Mar. 7, 1989

[54] METHOD FOR THE MANUFACTURE OF PLASTIC BAGS WITH WELDED SIDE SEAMS

[75] Inventor: Hans Reifenhauser, Troisdorf, Fed. Rep. of Germany

[73] Assignee: Stiegler GmbH Maschinenfabrik, Rudersbert, Fed. Rep. of Germany

[21] Appl. No.: 71,324

[22] Filed: Jul. 9, 1987

[30] Foreign Application Priority Data

Apr. 2, 1987 [DE] Fed. Rep. of Germany ..... 3711165

[51] Int. Cl.[4] ..... B65D 33/08

[52] U.S. Cl. ..... 383/10; 383/17; 383/37; 206/554

[58] Field of Search ..... 383/10, 6, 7, 8, 9, 383/17, 28; 206/554, 806

[56] References Cited

U.S. PATENT DOCUMENTS

| | | | |
|---|---|---|---|
| 1,726,740 | 9/1929 | Joffe | 383/10 |
| 3,442,437 | 5/1969 | Mann | 383/10 |
| 3,506,185 | 4/1970 | Christensen | 383/10 |
| 3,967,775 | 7/1976 | Kramming | 206/554 |
| 4,044,890 | 8/1977 | Kramming . | |
| 4,125,220 | 11/1978 | Suominen | 383/37 |
| 4,562,925 | 1/1986 | Pistner . | |
| 4,690,280 | 9/1987 | Meyer | 206/554 |

FOREIGN PATENT DOCUMENTS

| | | | |
|---|---|---|---|
| 0136171 | 4/1985 | European Pat. Off. . | |
| 1479271 | 5/1971 | Fed. Rep. of Germany . | |
| 2230993 | 1/1974 | Fed. Rep. of Germany . | |
| 1900337 | 3/1977 | Fed. Rep. of Germany . | |
| 2526014 | 8/1983 | Fed. Rep. of Germany . | |
| 3222376 | 12/1983 | Fed. Rep. of Germany . | |
| 474229 | 8/1969 | Switzerland | 383/10 |

*Primary Examiner*—Willis Little

*Attorney, Agent, or Firm*—Antonelli, Terry & Wands

[57] ABSTRACT

A process for the production of carry bags from synthetic resin film with lateral seams made by cutoff welding and with an approximately sinusoidal load-bearing rim with punched-in handle openings, involves a series of steps wherein a tubular film of double width and laid flat is cut open along its center in a wave shape with crests and troughs for the paired production of two sets of bags, and, along the cutting edges, turned-over rims are folded parallel to the folding edges, in each case either toward the outside or toward the inside, and the turned-over rims are welded (usually by heat bonding) at least partially to the lower end upper sheet layers of resulting semitubular lengths from the inside or outside, i.e. at least in a region surrounding the handle opening to be punched out subsequently.

20 Claims, 6 Drawing Sheets

Figure 1:
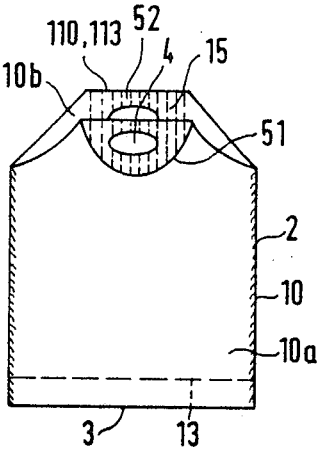

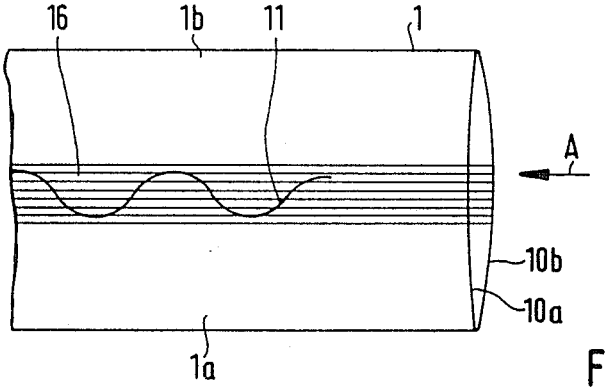
FIG. 4a
FIG. 4b
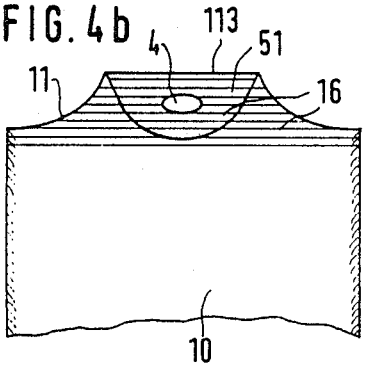
FIG. 4c
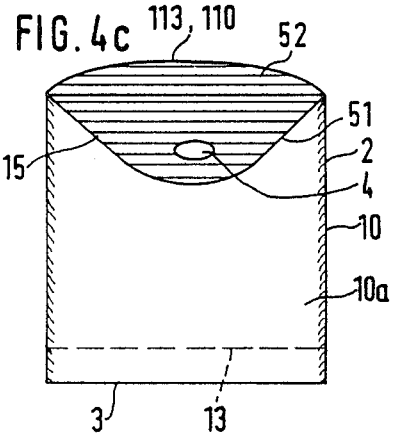
FIG. 7a
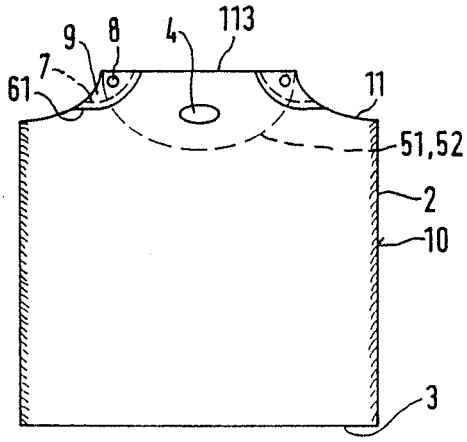
FIG. 7b
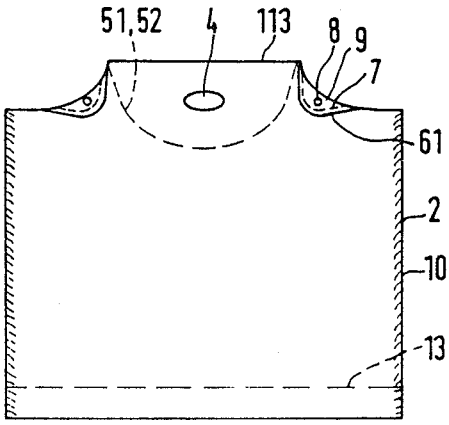

METHOD FOR THE MANUFACTURE OF PLASTIC BAGS WITH WELDED SIDE SEAMS

This invention relates to a process for producing carry bags from synthetic resin film with lateral seams made by cutoff welding and with an approximately sinusoidal load-bearing rim with punched-in handle openings, wherein a tubular film of double width and laid flat is cut open along its center in a wave shape with crests and troughs, especially in a sinusoidal shape, for the paired production of two sets of bags, and the two cut apart semitubular lengths of sheeting are pulled apart transversely to the conveying direction and further conveyed in a mutually displaced fashion so that crests and troughs of the semitubular sheets travel in synchronism, and then the handle openings are punched out and the side seams of juxtaposed bags are produced by cutoff welding transversely to the conveying direction, and the thus-formed bags are stacked.

The invention furthermore concerns side-seam carry bags, also called side-seam shopping bags, with an approximately sinusoidal load-bearing rim, which are selectively loose or optionally united into packs.

It is conventional to reinforce the areas of the handle opening in order to increase the load-bearing capacity of carry bags.

Packaging products of this kind, as set forth hereinabove, exist in a great variety of designs on the market, for example carry bags with side seam, handle opening and glued-in reinforcing leaf, with a straight carrying edge, or a sinusoidal carrying rim, made either into loose packs, see DOS No. 25 26 014, DOS No. 32 22 376, or into continuously united packs, in accordance with DOS No. 34 24 748.

Moreover, there are carry bags having a side seam and a handle opening with a load-bearing rim thickened by extrusion, in sinusoidal shape, combined into packs on dispenser stacking tubes, the two handle openings of a carry bag being designed to have a differing hole diameter; the large hole is located at the front and, when the carry bag is suspended, can simply be pulled off from the stacking tube for filling purposes.

The conventional packaging products of the aforedescribed type entail disadvantages during the manufacturing process as well as in practical handling. In case of carry bags made with a glued-on leaf reinforcement, such disadvantage resides particularly in the necessity of using an adhesive for providing the reinforcing leaves for the carrying handle, as well as in the requirement of a partial surface treatment of the appropriate side of the sheeting, additionally necessary in the majority of cases, in order to obtain satisfactory adhesion of the glue. The glue as well as the pretreatment method are, inter alia, a danger to the environment; furthermore, the adhesive makes the product more expensive.

It is also desirable in many cases to provide the bags united in a pack for economical filling. In particular, the object resides in providing such united packs for an economical manufacture of the bags and a rapid, unimpeded handling at the check-out counter when filling the bags, for example in department stores. Handle opening designs with varying hole diameters of the bags with the use of stacking tubes do not as yet offer adequate assurance in this respect. On the other hand, the bags with or without an interconnecting rim projecting past the load-bearing rim in accordance with DOS No. 25 26 014 or DOS No. 34 24 748 have the drawback that they can be realized only with a reinforcing leaf glued to the bag sheeting by means of an adhesive, this leaf simultaneously reinforcing the handle opening. The manufacturing process starts with tubular sheeting cut open in the center to form two sheet lengths, the marginal strips being folded over in the middle of the conveying path, the cut-to-size reinforcements being glued to the folded-over marginal strips and the uncovered sheet.

Moreover, it has been known in the production of bags with a bottom seam from EP-OS No. 0136 171 to interconnect these bags in a zone above the handle opening or at the upper opening rim with respectively one bag side, by previously punching out the counter piece on the side opposite to the interconnecting zone.

The invention is based on the object of proposing a simple and economical process for, in particular, the paired manufacture of side seam bags with handle opening, which bags are made with an approximately sinusoidal load-bearing rim with a welded-in handle opening reinforcement and are optionally united into packs and, in such form, can be readily opened and filled.

In order to retain to attain this object, the invention proposes, in the process of this type, to fold over, along the cutting edges, turned-over rims in parallel to the folding edges in each case either toward the outside or toward the inside, and to weld the turned-over rims to the lower and upper film layers of the semitubular sheeting from the inside or outside at least partially, i.e. at least in the region surrounding the handle opening to be punched out subsequently.

The invention makes it possible, by following the same process technique with minor steps that can be selectively added or omitted, to manufacture differently structured carry bags with a side seam, with a reinforced handle opening, in pairs, loosely or interconnected into packs, in a tear-off design. This means that the variously designed bags can be produced in a single machine installation. The process of this invention offers advantages with respect to product technology as well as process technology over the conventional methods. These are, in particular, harmlessness to the environment by elimination of the use of adhesives, and thus also omission of a surface pretreatment when producing the handle opening reinforcement; and simple manufacture by folding over the rims of the sheeting and fastening by contact welding instead of the gluing procedure. In this connection, according to this invention, a contact welding method is employed, in particular, wherein a plurality of spot-like welding areas are applied in the manner of a welding raster, in this connection, a denser grid of point-like weld areas can be applied around the handle opening to increase load-bearing capacity and resistance to tearing, which grid can decrease to zero density toward the side seams. The grid-like spot welding increases the tear strength and grip of the load-bearing rim without rendering same rigid—as is often caused by layers of adhesive—and without additional thickening. Moreover, no waste of tubular film is encountered. In a further development of the process of this invention, the manufacture of interconnected bags is likewise made possible, the interconnection being effected in the zone of a sheeting layer, namely respectively the lower sheeting layer, representing later on in the pack the rear side of the bag. Interconnecting is provided according to the invention above or laterally of the zone of the handle opening. The process of this invention moreover does not only provide the production of bags having a straight load-bearing rim—in case the entire crest of the wave is folded over—but especially also with a sinusoidal rim configuration whereby the bag opening is enlarged and filling of the bag is improved. It is furthermore to be emphasized that practically no waste or discarded strips are produced, i.e. an optimum utilization of the tubular sheeting is made possible.

The process technique according to this invention is based, in an economical fashion, on a double-web production method wherein a laid-flat tubular film is utilized of double width—in correspondence with the parallel manufacture of two rows of bags, simultaneously—which alternatively can already carry an imprint or can also be provided with integrated in-line printing. Insofar as imprinted bags are desired, it is, of course, also possible to perform the process of this invention starting with two preprinted laid-flat sheeting lengths with a folding crease, or to use two individual rolls of tubular or semitubular sheeting, selectively preprinted or with integrated in-line printing. Moreover, according to this invention, it is likewise feasible to employ tubular film having strips where the material is thickened by extrusion, extending in the region of the subsequent carrying rim in the two plies of sheeting. Consequently, reinforcement of the load-bearing rim or the region of the handle opening is possible to double the tubular film thickness, with a constant thickness of the tubular film, or to 3 to 4 times the thickness of the tubular film in case of sheeting layers already doubled in certain areas in thickness by means of extrusion-thickening.

The invention provides the formation of the handle opening reinforcement by turning over the sheeting rim or a portion thereof and welding same onto the sheeting plies even in case of a double-lane manufacturing process, starting with a double-wide laid-flat tubular film. Since in case of a double-lane mode for the paired manufacture of bags or packs of bags starting with a double-wide tubular film, the length of material, after unwinding, first is to be severed in the middle, whereby two half tubes result with opening rims extending longitudinally on the middle of the machine, the semitubes can either be pulled apart somewhat laterally in order to provide room for manipulation in the center, or the two semitubular lengths are, according to another proposal of this invention, folded over or, respectively, guided so that the opening cutting edges are conducted to the outsides of the machine and therealong. Thus, according to this invention, after the tubular film has been cut open along the center of the sheeting, the resultant semitubular length of sheeting extending on the right-hand side is brought, by a corresponding rerouting, to the left-hand inlet side, and the semitubular length of sheeting extending on the left-hand side is brought to the right-hand inlet side. In a preferred further development of the invention, the provision is made that, after deflection of the semitubes, the straight opening edges extending on the outside or, in case of sinusoidal outer edges, the straight folded edges extending on the inside are aligned by edge control, and in case of a sinusoidal opening edge cut, these folded edges are further guided mutually offset in such a way that the crests and troughs are conveyed further in synchronism. The edge control makes it possible to effect the correct entrance of the half tubes and their opening cutting edges into the subsequent device for the folding over and welding-on of the rim reinforcement. In the rerouting of the semitubular sheeting lengths, the provision is also made according to the invention that the two sheeting length rerouting units for the two semitubes can be positioned independently of each other so that the exact position of the bags to be severed later on can be controlled, especially in case of a sinusoidal opening edge cut, so that the wave crests and the wave troughs travel at the sam level, and the paired manufacture of the bags is possible with dimensional accuracy by means of the correspondingly pair-wise equipped tool units. A roll adjustment mechanism can be utilized, for example, as the sheeting rerouting and positioning device.

If desired, during continued entrance of the semitubes in the direction of the cutoff welding device, bottom pleats are inserted in the continuous pass-through zone of the half tubes along the folding edges extending in the middle of the conveying path.

In order to obtain bags having an approximately sinusoidal load-bearing rim with at least a reinforced handle opening zone, the turned-over rims are formed from the sinusoidally extending cutting edges of the opening of the half tubes by folding over at least part of the crests; the turned-over rims can be folded over either toward the outside or toward the inside of the half tube, and the turned-over rims are joined with adhesive strength by means of contact welding to the lower and upper film plies of the semitubes. The size of the folded-over area depends on the desired dimensioning and configuration of the carry bag and its load-bearing rim. In case of minor amplitudes of the crests with a height H of up to about 80–90 mm, the crest is folded over entirely or at least to its predominant extent, since there still is to remain an adequate edging for the handle opening to be punched out. In case of crests having a height H of about 80 or 90 to 180 mm, a partial turning over of the crest to form the edge reinforcement is preferred, especially by about half the height of the crest.

By means of the turned-over edges, a reinforcement of the zone of the load-bearing rim with the handle opening to double the sheeting thickness of the tubular film employed can be achieved, i.e. with a tubular film having a thickness of 45 μm, the load-bearing rim has a thickness of 90 μm.

Further reinforcement of the load-bearing rim zone can be obtained by using tubular films with strips thickened by extrusion, these strips extending in the region of the subsequent load-bearing rim of the bag walls; the turned-over rims are formed entirely from the strip thickened by extrusion. In this way, a load-bearing rim is achieved having at least approximately triple the thickness of the film thickness insofar as, by extrusion thickening, doubling has been obtained in this zone. Such carry bags exhibit the great advantage that the reinforcement in the zone of the load-bearing rim extends over the entire width of the bag and is additionally reinforced even further in the region of the handle opening by the turned-over margin.

The welding on of the turned-over rims can be performed, for example, discontinuously in a cyclic fashion by means of appropriate contact welding plates over the entire width of the turned-over rim or only in selected partial zones.

This procedure is followed by the cyclic punching in of the handle openings into the reinforced zone, i.e. the area formed by folding over of the turned-over rim. The thus-produced carry bags with a sinusoidal, reinforced load-bearing rim, i.e. a rim having at least twice the film thickness, with handle opening, are accumulated into loose packs and passed on to consumption.

In order to make it possible to interconnect the bags, a further proposal of the invention provides to make the turned-over rims of the lower film plies of the semitubes narrower, i.e. with a smaller height than the turned-over rims of the upper film plies, and the projecting marginal strip formed in this way at the bottom film ply is utilized to interconnect the bags with one another for packing, or this can be done starting with the top film ply. The interconnection section, i.e. the projecting marginal strip, is provided with a perforation along the turned-over rim of the upper film ply, and the bag, when needed, can be torn off from the continuous pack along this rim. The tear-off perforation can be punched before or after the welding of the separating seam. For bags which, according to the invention, are to receive two lateral interconnection sections and partially sinusoidal load-bearing rims, another feature of the invention resides in punching out arcuate sections from the top film ply as counterpieces to be removed, for respectively two interconnecting sections of a bag which are arranged on both sides of the handle opening zone. This punching out step can be performed after punching the handle openings or simultaneously with the punching of the latter. Holes for hanging are punched into the interconnection section. The lateral interconnection sections are preferably arranged within the width of the bag rather than directly adjoining the side seams. In this way, the bags, in the interconnected, i.e. hanging condition, can be adequately easily opened up for sufficient filling and, after the filling step is finished, can be readily seized in the handle openings from above, i.e. in the manner the carrying hand will finally seize the bags, and the bags are only thereafter torn off from the thus-united series of bags. The interconnection section can also be located entirely or partially in the doubled area, i.e. in the zone where the rim has been turned over.

A further reinforcement of the load-bearing zone with handle openings of the side-seam bags is also possible, for example, by welding an additional reinforcing leaf made of a synthetic resin sheet onto the provided turned-over rim or onto the area of the film ply wherein the turned-over rim is welded, before the turning-over step, and welding this leaf to the turned-over rim after the folding-over step and to the film ply. This reinforcing leaf should then extend around the handle opening so that high tear strengths and load-bearing capacities can be obtained. Preferred embodiments for the production of interlocked side seam bags can be seen from the detailed description which follows with respect to FIGS. 5 and 6, for example.

By means of the process of this invention, it is possible to punch, with only one tool holding traverse extending transversely across the conveying path, the handle openings of the two bags guided in side-by-side relationship, selectively in a C cut, or in a kidney-shaped, banana-shaped, oval, or round configuration, along with, optionally, the row of perforations for the interconnection section extending in the bottom film ply exactly beside the turned-over rim of the top film ply. However, it is also feasible to effect interconnection, as well as punching of a handle opening, hanging hole, and tear-off perforations for the bags as late as on the already stacked, continuous pack. It is in each case possible to equip and control the punching units uniformly with only one drive mechanism.

A special advantage of the process of this invention is to be seen in that the new bag to be separated, already lying on the pack in an orderly stack, is welded (interconnected), or can be welded (interconnected) still during the cutoff welding of the side seams, simultaneously during the cutoff welding of the side seams in the zone of the interconnection section, to the pack individually by means of a strip-wise or spotwise joining step. This mode of operation according to the invention has the advantage that the thus-produced bag is still held in an exactly defined position by the cutoff welding unit and thus the interconnection position is also defined, and interconnection can be carried out. Since the interconnection section is maintained as small as possible, if only for reasons of material and waste, an exact positioning is necessary; moreover, the interconnecting welding step must extend in any event outside of the tear-off perforation row.

After reaching the number of bags desired per pack, these bags are seized by a gripper device associated with the depositing unit, and are optionally first advanced into a subsequently provided punching position. Here, those punching steps are performed which have not as yet been executed, in correspondence with the desired shape of the bag, i.e., for example, the subsequent punching out of the hanging holes and, if desired, the row of tear-off perforations insofar as these have not been executed earlier in conjunction with cutting out of the recess; or also additionally the joining of the bags loosely collected into packs and advanced by a gripper device, if these bags have not as yet been individually joined together.

It is possible by means of the process of this invention to manufacture economically bags having a reinforced load-bearing rim of sinusoidal shape; in this connection, the process makes it possible to variably adjust the height of the sinusoidal rim by appropriate positioning. Very large amplitudes of the wave crests are possible, permitting the production of the turned-over rim by halving the amplitude during the folding step.

Figure 2:
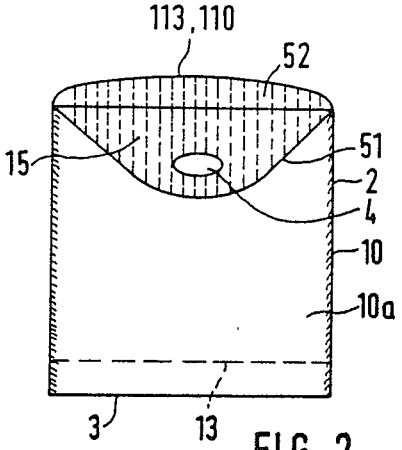
Figure 5:
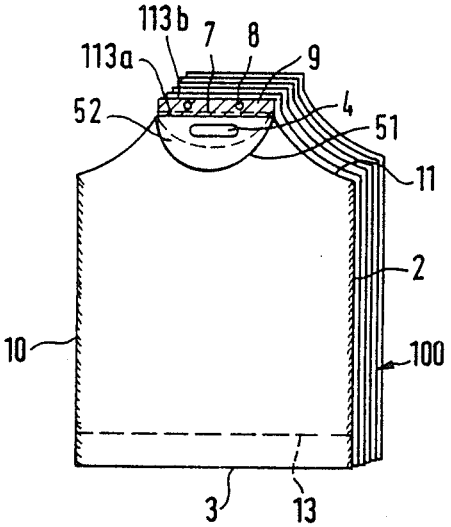
Figure 6:
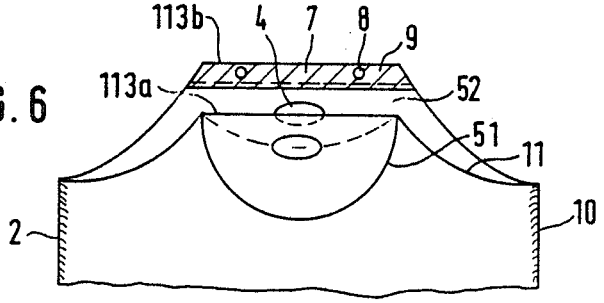
Figure 8:
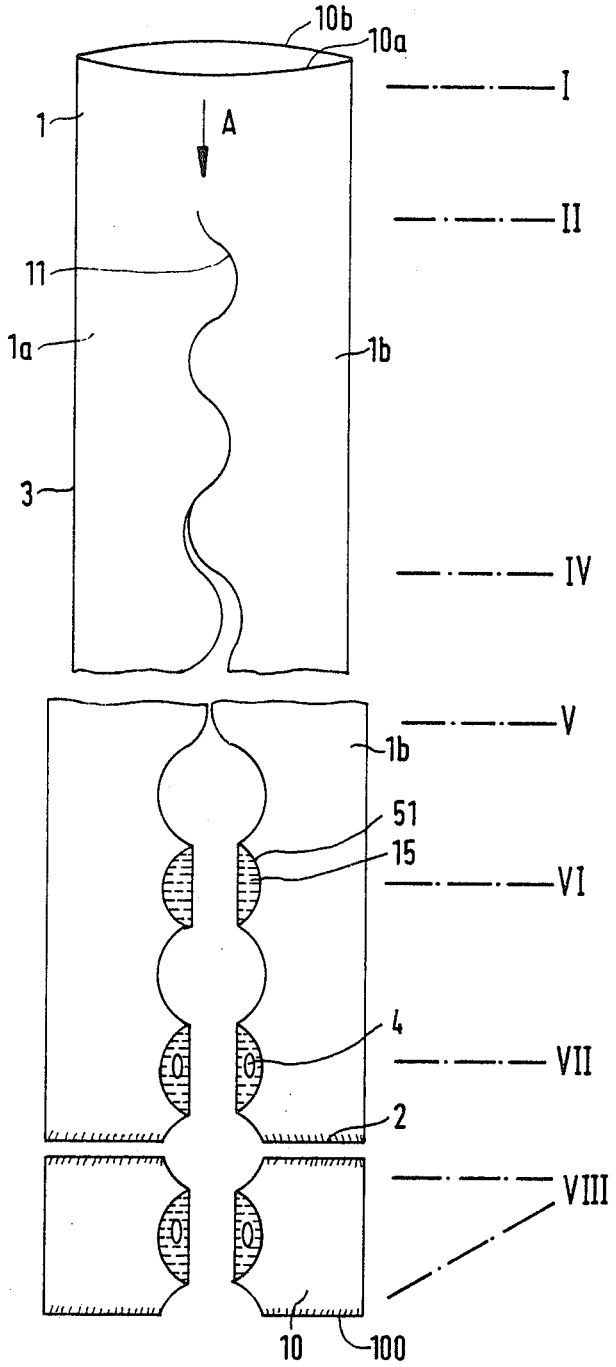
Figure 9:
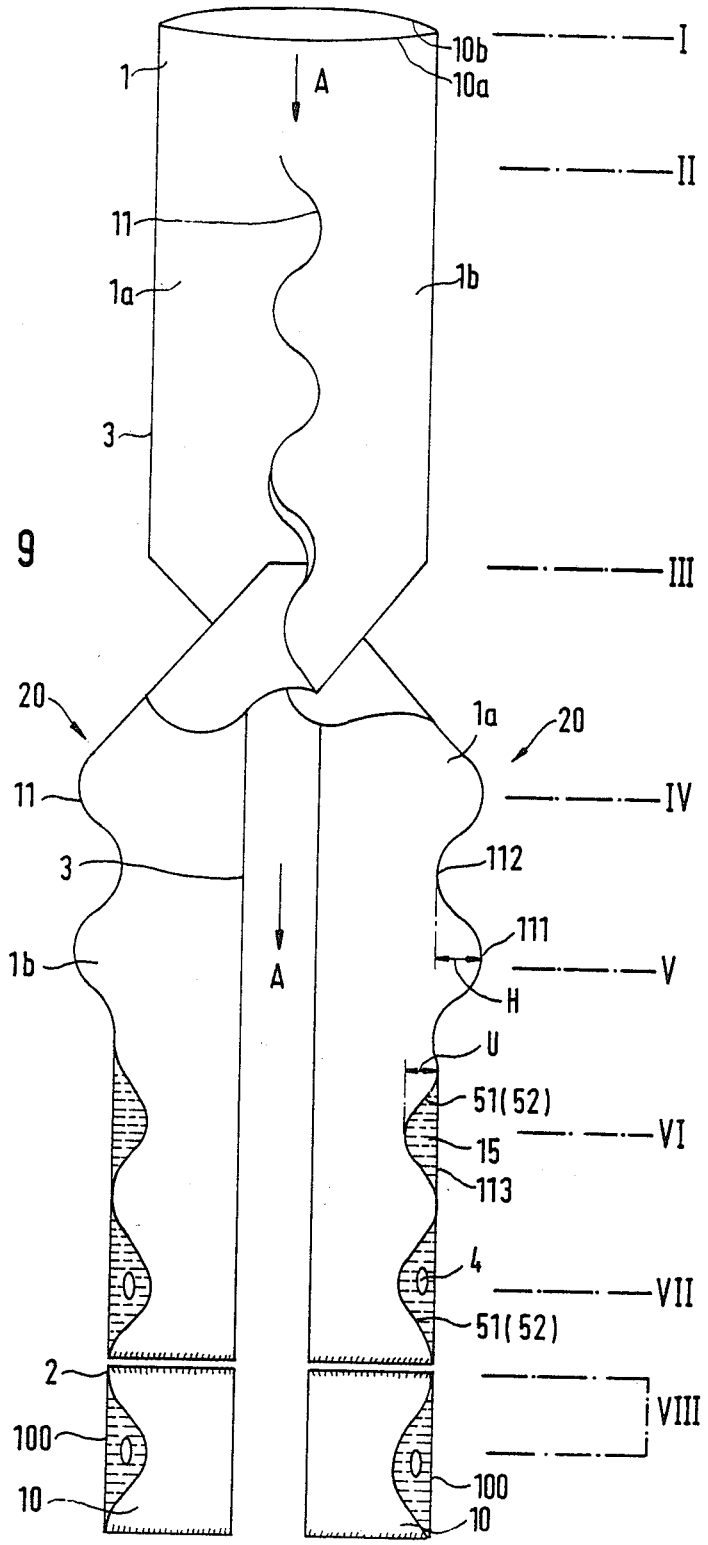
Figure 10:
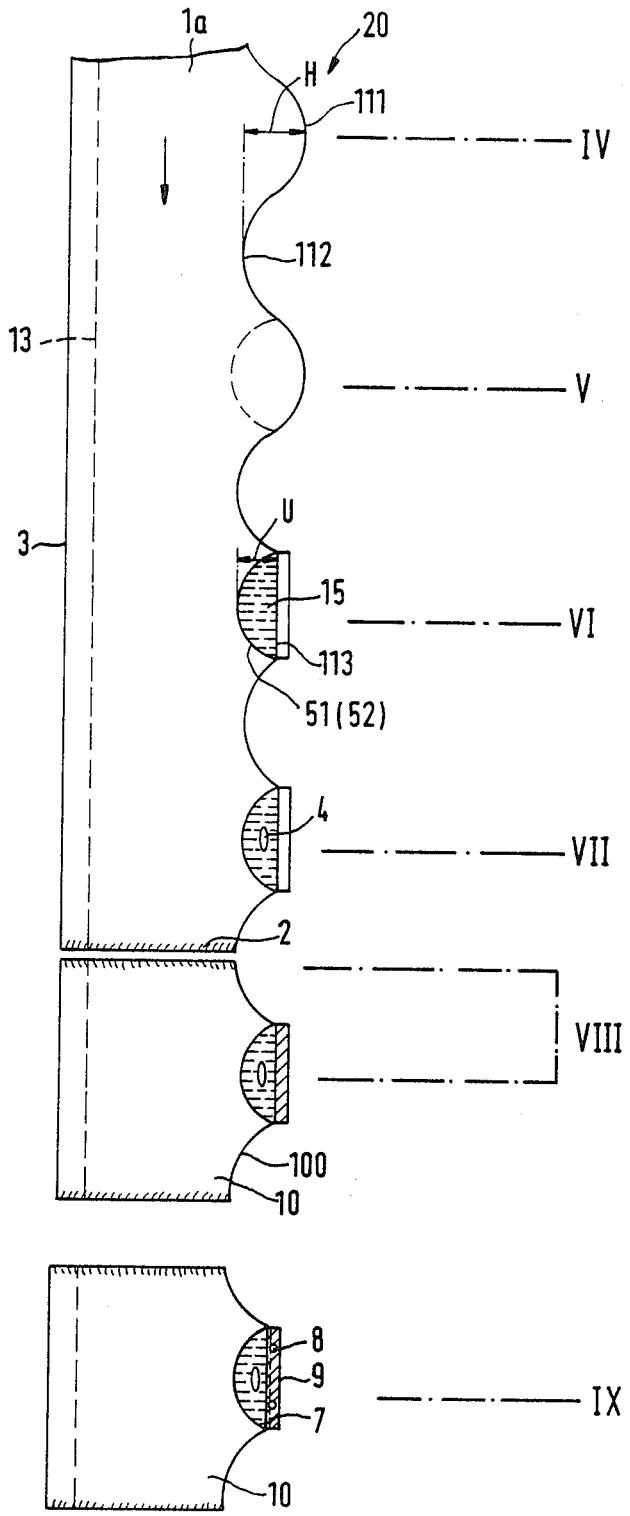

Various products can be manufactured by means of the process of this invention. This includes, in particular, bags having a side seam and a handle opening with reinforcements of the handle opening formed by turned-over rims folded over toward the outside or inside and being at least partially attached by welding, these bags being fashioned with a sinusoidal carrying rim of differing height (amplitude) and being either collected into loose packs and usable in this way, or optionally being interconnected into packs above or laterally of the handle opening and being designed by means of a tear-off perforation for the interconnecting sections, so that they can be torn off from the pack.

process of this invention and the products that can be manufactured thereby according to this invention will be described by way of example with reference to the drawings which are schematic illustrations and wherein:

FIGS. 1 and 2 are views of bags with side seam and with reinforcement of the handle opening by means of turned-over rims, FIGS. 3*a*, 3*b*, 3*c*, 4*a*, 4*b* and 4*c* show bags with reinforcement of the handle opening, made of a film with extrusion-thickened strips, FIGS. 5 and 6 show views of an interconnected bag with side seam in a pack, and in an excerpted detail, interconnected by differently large turned-over rims, FIGS. 7*a* and 7*b* show bags with lateral interconnection sections, FIG. 8 shows a schematic view to illustrate a process for producing bags with side seams and handle opening reinforcements by a turned-over rim as shown in FIG. 1, FIG. 9 is a schematic view of a process for producing bags as shown in FIG. 2, FIG. 10 is a schematic view of the process for manufacturing bags with interconnection sections as shown in FIGS. 5 and 6.

FIGS. 1 through 5 illustrate various carry bags 10 that may be produced according to this invention and that are equipped with approximately sinusoidal load-bearing edge portions, each bag comprising side seams 2 and handle openings 4 reinforced by turned-over rims 51, 52, a folded bottom edge 3 and a selectively or optionally provided bottom crease 13. The two film plies 10, 10*b* of the tubular film 1 of a thermoplastic synthetic resin, see FIGS. 8 and 9, of which the bags 10 are manufactured, constitute the front wall 10*a* and the rear wall 10*b* of the bags. The front and rear turned-over rims 51, 52, folded over along the bag aperture or opening and along the load-bearing rim 110 toward the outside or inside, are welded to the bag walls 10*a*, 10*b* at least in partial zones, see shaded areas 15. Welding can take place advantageously according to a pattern with spot-like welding areas, also, for example, as a grid. The welded areas can extend over the entire folded-over portion of the rim or can also be limited to only the area surrounding the handle opening in its direct vicinity. In this way, the load-bearing rim as a whole is strengthened.

The carry bags according to FIGS. 1 and 2 are produced from tubular films having a sinusoidal cutting edge at the opening. The bag of FIG. 1 has a handle openng 4 reinforced by folding over approximately half the wave crest as a turned-over rim 51, 52 of an originally sinusoidal edge along the folding edge 114 toward the outside and by welding to the front or rear wall 10*a*, 10*b*. The load-bearing rim 119 thus represents a flattened sinusoidal shape. The bag 10 according to FIG. 2 has a handle opening reinforcement produced by folding over the entire wave crest 111 as a turned-over rim 51, 52 along the folding edge 113 starting in the region of the wave trough 112 of a sinusoidal original cutting edge (see FIG. 9); this folding edge 113 then constitutes the reinforced load-bearing rim 110 of the bag 10. The turned-over rims can be folded toward the inside or outside and can be welded to the bag walls over the entire surface or only in part. The bags can be manufactured with and without an inserted bottom crease 13.

Figure 3A:
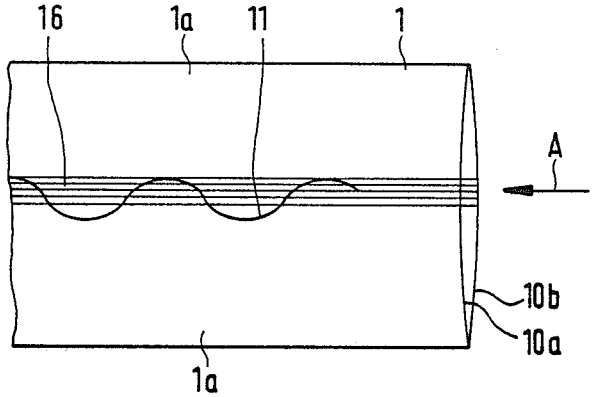
Figure 3B:
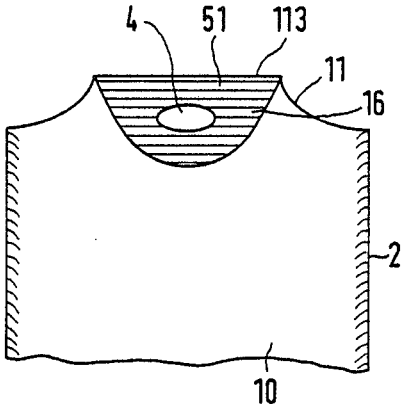
Figure 3C:
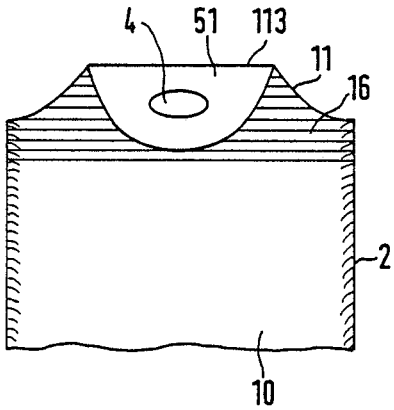

For producing bags having a load-bearing rim thickened by extrusion, the sinusoidal opening cut 11 of the tubular film 1 extends either entirely within the thickened strip 16 extending in the longitudinal direction of the film see FIG. 4*a*, or only partially, for example, approximately along one-half, see FIG. 3*a*. It is also possible to provide a thickened zone only in the middle region of the sinusoidal opening cut. The thickened strip 16 extends in the upper and lower film ply 10*a*, 10*b* in the extrusion direction A and thus in the area of the subsequent load-bearing rims. In the configuration of the tubular film according to FIG. 3, sinusoidal cut 11 is provided with wave crests of large amplitude, for example 180 mm, so that when the crests are folded over by one-half thereof, the thickened strip 16 is present respectively on the film or on the turned-over rim. In this case, in mutual supplementation, the bags 10 are produced as, respectively, shown in FIG. 3*b* and FIG. 3*c*. In case of FIG. 3*c*, the thickened strip 16 extends below the folded rim 113 of the turned-over rims 51, 52 in each film position. The folded turned-over rims are adhesively connected to the front wall 10*a* and to the rear wall 10*b*—on the inside or outside—b means of welding. In this connection, the turned-over rims can partially overlap the extrusion-thickened strip 16. The handle openings 4 are punched into the turned-over rims 51, 52. In the embodiment according to FIG. 4*c*, the height of the crest need only amount to 90 mm; the width of the thickened strip 16 is of a corresponding dimension. In the bag according to FIG. 4*b*, the height of the crest should again be larger, for example 160 mm, with a width of the thickened strip of about 100 mm and with a turned-over rim of about 80 mm. The bags 10 illustrated in FIGS. 1 through 4 are collected into loose packs and passed on to consumption in this form.

However, in many instances, interconnected packs of bags are desirable. FIGS. 5 and 6 show a bag 10 designed with a junction section 9, hanging holes 8 within the junction sections, and a tear-off perforation 7 making the bag 10 removable by tearing off from the junction section. The junction sections 9 are formed on the rear wall 10*b* of the bag 10 by folding over the rearward turned-over rim 52 with a smaller height than the forward turned-over rim 51, so that a marginal strip 9, utilized as the interconnecting section, is produced which projects with the folding edge 113*b* of the turned-over rim 52 produced on the rear wall 10*b* beyond the front folding edge 113*a* of the turned-over rim 51 produced on the front wall 10*a*. In this embodiment of a bag having a sinusoidal carrying rim 11 with interconnection possibility, the two turned-over rims reinforcing the handle opening 4 are of differing size, but this does not represent any impairment of functional ability.

FIG. 5 shows schematically a view of the bag 10 according to FIG. 6 on a united pack 100. The bag 10 can readily be seized and opened by grasping the front folded-over edge 113*a* and, optionally after filling, can be torn off via the tear-off perforation 7 from the interconnection 9. The pack 100 can be suspended on hooks or the like by means of the hanging holes.

FIGS. 7*a* and 7*b* show bags 10 with interconnection sections 9 on both sides of the handle opening 4. In order to provide sufficient room for the interconnection sections 9, the turned-over rims 51, 52 are smaller than the amplitude of the crests so that there still remains on the side an arcuate cutting edge 11 beside the straight folding edge 113. The interconnection sections are arranged in the transition from the folding edge 113 to the sinusoidal marginal edge 11; in FIG. 7 *a*, the interconnection sections still invade or enter the turned-over rims 51, 52 which here are preferably laid inwardly. The interconnection sections 9 are formed by cutting out corresponding sections from the front wall 10*a* of the bag, and in each interconnection section 9, a hanging hole 8 is provided. In order to impart to the bag 10*a*, after severing from the pack, an approximately sinusoidal load-bearing rim, the front side 10*a* of the bag is formed with arcuate cut-out edges 61 in the corner zone, uncovering the interconnection section 9 of the rear wall, and in parallel to the cut-out edge 61, for example, the rows of perforations 7 ar provided in the rear wall 10*b*, along which the bag 10 can be severed from the pack and from the interconnection sections 9.

Also, these bags can be readily filled, opened, seized, torn off.

FIGS. 8 and 9 show schematically the procedure for manufacturing the side seam bag 10 with a handle opening 4 reinforced by a sinusoidally shaped folded portion, for example, according to the embodiment of FIGS. 1 and 2. In order to produce two bags side-by-side in parallel, the starting point is a double-wide, laid-flat tubular film 1 for double-lane manufacture. The tubular film 1 fed continuously in the direction of arrow A by way of station I is then cut open in a sinusoidal configuration at the separating cutting station II in the center of the film. In the embodiment according to FIG. 9, a sinusoidal cutting step is performed whereby the two semitubes 1*a*, 1*b* are formed with sinusoidal opening cutting edges 111, 112. Since manipulations must be performed especially along the opening cutting edges 11, in order to produce the desired bags, these must either be pulled apart, as illustrated in FIG. 8, or guided over two folding stations III in such a manner that the semitubular length of film 1*a* previously traveling on the right will subsequently continue its travel on the left, and the semitubular length of film 1*b* previously on the left-hand side will continue its travel on the right whereby the opening cutting edges 11 extend to the outsides 20 of the conveying path and then along the outsides of the conveying path, and thus become readily accessible for processing and handling. The folded edges 3 of the tubular film previously extending on the outside then extend, in FIG. 9, in the center of the conveying path. After pulling apart and rerouting have thus been accomplished, bottom pleats can be added directly in a bottom-inserting station IV, at the folding edges 3; this is not illustrated in detail. In the subsequent station V, turned-over rims 51, 52 are formed continuously along the opening cutting edges 11 by folding over the film rims of the upper and lower film plies 10*a*, 10*b* of the semitubes 1*a*, 1*b* toward the inside or outside in the desired height U, and are firmly joined by contact welding in station VI with the respectively upper and lower film ply. Depending on the design of the bag, the welding zone 15 can occupy the entire turned-over rim 51 or 52 (upper and lower film ply), or it can cover only a partial zone, for example around the handle opening and, if desired, in the region of the side seams. The next step is a punching station VII wherein, for example, a toolholding traverse with the punching units for carrying handle holes 4, extending transversely across the two semitubes, is provided. This is followed by the station VIII wherein the side seams 2 are produced by cutoff welding of the bags 10. During this step, the bags are loosely stacked one on top of the other into packs 100.

If bags according to the design of FIGS. 5 and 6 are to be produced, the procedure is followed as schematically illustrated, for example, in FIG. 10 in a fragmentary view. In station V, the turned over rims 51, 52 of the upper and lower film plies are folded over to varying heights U so that the folding edge 113*b* of the lower film ply 10*b* projects beyond the folding edge 113*a* of the upper film ply 10*a*. Then the turned-over rims 51, 52 are welded to the film plies in station VI. In station VII, only the handle opening 4 is punched out. This is followed, as station VIII, by the cutoff seam welding station combined with the interconnection device. Still during the welding of the side seam 2, the bag 10 lying on the pack 100 is joined in zone 9, i.e. while the bag is still held in an accurate position by means of the welding beams.

For forming bags with two joining sections 9, for example according to the embodiments of FIGS. 7*a,b*, a process according to FIG. 8 is used for punching out, subsequently to or simultaneously with the punching out of the handle opening 4 of station VII, the counter pieces, to be removed or punched away, related to the interconnection section to be formed on the bottom film ply, from the top film ply 10*a* of the semitubes. In the next station, even before the separating welding station, a toolholding traverse can be provided with punching units for the row of perforations extending on the lower film ply and defining the interconnection section, and optionally for the hanging holes. The punching units mounted to the toolholding traverses are exchangeable and adjustable and thus can be adapted to varying bag designs.

When performing the process for producing bags having a sinusoidal rim, only a minimum amount of waste originates for the interconnection edge, as measured in comparison to the film width. The carry bag and/or shopping bag can be hung up in united packs and can be filled without problems. The height of the sinusoidal rim can be varied in the suggested process to up to about 110 mm, with the mechanical equipment remaining the same.

The cutoff welding unit station VIII also includes a collective stacker, not shown in detail, for the bags 10 produced and separated by the cutoff welding step, the cutoff welding device being followed directly by a rotating seam cooling means, for example revolving rods in which are received the still hot, welded side seams of the bags for being individually cooled until they can no longer stick together, by welding action, with the bags of the pack. During this cooling off phase, the subsequent bag width is already advanced through the welding unit and deposited on the pack, and during the next cycle of the cutoff welding operation, the deposited bag is simultaneously welded, in the interconnection zone, to the pack, if such interconnection is intended.

After reaching the number of bags desired per pack, the united pack 100 is removed from the depositing site directly behind the cutoff welding unit. For designing the bags or packs according to FIGS. 5 and 6, a punching station is then provided for the interconnected pack after the cutoff welding station VIII; in this punching station—insofar as not as yet performed—it is possible to execute at least the punching of the pair of hanging holes in the interconnection zones, and the punching of the tear-off perforations, unless this has been done already before arriving at station VIII, at the same time. Also these punching tools are variably adjustable by their positioning and thus can be adapted to differing bag formats and designs.

What is claimed is:

1. A process for the production of carry bags from synthetic resin film with lateral seams made by cutoff welding and with an approximately sinusoidal load-bearing rim with punched-in handle openings, wherein a laid-flat tubular film of double width with two parallel folding edges is cut open along its center in a wave shape with crests and troughs, especially sinusoidally, for the paired production of two sets of bags, two-cut apart semitubular lengths of film having cut edges and a folding edge are pulled apart transversely to the conveying direction and further conducted in a mutually displaced fashion so that the crests and troughs of the semitubular lengths of film are guided in synchronism, the handle openings are punched, the lateral seams disposed side-by-side are produced by cutoff welding of the semitubular lengths of film transversely to the conveying direction and the thus-formed bags are stacked, characterized in that, after pulling apart of the two cut-apart semitubular lengths of film, turned-over rims are formed in each of the semitubular lengths of film by folding over at least part of the crests in parallel to a folding edge respectively either toward the outside or toward the inside, and the turned-over rims are welded at least in a zone surrounding a handle opening to be subsequently punched, respectively, to lower and upper film plies of the semitubular lengths of film.

2. A process according to claim 1, characterized in that the turned-over rims are formed with the sinusoidally extending opening cutting edges by folding over at least part of the crests, and the turned-over rims are bonded to the lower and upper film plies of each semitube by means of contact welding with heat.

3. A process according to claim 1, characterized in that crests having a height (H) of up to about 80–90 mm are folded over approximately in their entirety, and those having a height (H) of about 90–180 mm are folded over partially.

4. A process according to any one of claims 1 to 3, characterized in that the turned-over rims are joined to the film plies by way of a plurality of spot-like welding areas forming a raster.

5. A process according to claim 1, characterized in that said tubular film is formed with strips thickened by extrusion, said strips extending in the region of the a subsequently formed load-bearing rim of the bag.

6. A process according to claim 5, characterized in that the turned-over rims are formed entirely from the strip of the semitubular lengths of film thickened by extrusion.

7. A process according to claim 1, characterized in that the two semitubular lengths obtained by centrally cutting apart the length of tubular film are rerouted to mutually interchange conveying routes, so that opening cutting edges of the semitubular lengths of film previously extending in the center of a conveying route are guided along the outsides of the conveying route, and the turned-over rims are folded over toward the outside or toward the inside from the outsides.

8. A process according to claim 7, characterized in that, after rerouting the semitubular lengths, the opening edges extending on the outside along the conveying route are aligned by edge control along the opposite, linear edge of the route and, in case of a sinusoidal cut of the opening edges, are further conveyed with mutual displacement by way of a film length guiding and positioning device so that the crests and troughs of the two semitubular lengths are guided in synchronism.

9. A process according to claim 1, characterized in that the turned-over rims of the lower and, respectively, upper film plies of the semitubular lengths of film are narrower than the turned-over rims of the upper and, respectively, lower film plies, so that the lower or, respectively, upper film ply forms with respect to the folding edge a projecting marginal strip usable as and interconnection section.

10. A process according to claim 1, characterized in that there are punched out, on both sides of the handle opening, from the upper film ply of the semitubular lengths approximately arcuate cutouts as counterpieces, to be removed, for respectively two interconnection sections to be formed on the rear wall of the bag, and selectively hanging holes and/or tear-off perforations are likewise punched out.

11. A process according to claim 9 or 10, characterized in that there takes place, simultaneously with the production of the side seams by cutoff welding, the individual interconnecting of the thus-formed bags into packs with the precedingly produced and stacked bags, by welding at the interconnection sections projecting above and, respectively, laterally of the zone of the handle opening, or the interconnecting of the bags is performed, after having been stacked into a pack, in a separate interconnection station integrated into the depositing device.

12. A process according to claim 11, characterized in that, in the interconnected packs of bags, the hanging holes located in the zone of the interconnection sections and, the tear-off perforation for the interconnection sections are punched out from the bottom film ply.

13. Carry bag from synthetic resin film with lateral seams made by cutoff welding and with an approximately sinusoidal load-bearing rim with punched-in handle openings, and folded bottom edge, manufacture by cutting a laid flat tubular film of double width along its center in a wave shape with crests and throughs, especially sinusoidally, characterized in that turned-over rims are formed by sinusoidally extending opening cutting edges by folding over at last part of the crests parallel to the folded bottom edge, respectively either toward the outside or toward the inside, and the turned-over rims are welded together at least in a zone surrounding the punched-in handle opening to the front and rear wall of the bag.

14. Carry bag according to claim 13, characterized in that the turned-over-rims are folded over approximately in their entirety in case the crests having a height (H) of about 80 to 90 mm.

15. Carry bag according to claim 13, characterized in that the turned-over rims are folded over partially in case the crests having a height (H) of about 90 to 180 mm.

16. Carry bag according to claim 13, characterized in that the turned-over rims are joined to the front and rear walls of the bag by way of a plurality of spot-like welding areas for forming a screen (raster).

17. Carry bag according to claim 13, characterized in that the front and rear walls are formed by a tubular film comprising strips thickened by extrusion, these strips extending in the region of the load-bearing rim, parallel the folded bottom edge.

18. Carry bag according to claim 17, characterized in that the turned-over rims are formed entirely from the thickened strips of the film.

19. Carry bag according to any one of claims 13 to 18, characterized in that the turned-over rim of the rear wall of the bag is narrower that the turned-over rim of the front wall, so that the rear wall is projecting the front wall of the bag by forming a marginal strip usable as interconnection section.

20. Carry bag according to any one of the claims 13 to 18, characterized in that there are punched out, on both sides of the handle opening, from the front wall approximately arcuate cutouts as counterpieces forming two interconnection sections on the rear wall of the bag, the counterpieces comprising punched hanging holes and tear-off perforations.

* * * * *